US007257967B2

(12) United States Patent
Rheinstein

(10) Patent No.: US 7,257,967 B2
(45) Date of Patent: Aug. 21, 2007

(54) CONVERTIBLE IDENTIFICATION (ID) TAG AND JEWELRY

(76) Inventor: Linda Rheinstein, 5623 Mammoth Ave., Sherman Oaks, CA (US) 91423

( * ) Notice: Subject to any disclaimer, the term of this patent is extended or adjusted under 35 U.S.C. 154(b) by 0 days.

(21) Appl. No.: 10/178,167

(22) Filed: Jun. 24, 2002

(65) Prior Publication Data

US 2003/0233844 A1 Dec. 25, 2003

(51) Int. Cl.
*A44C 25/00* (2006.01)
*A44C 11/02* (2006.01)
*A44C 15/00* (2006.01)

(52) U.S. Cl. ..... 63/40; 63/3.1; 63/1.11; 63/4

(58) Field of Classification Search ..... 63/1.11, 63/1.13, 1.16, 1.18, 21–23, 41, 4, 5.1; 40/1.5, 40/124.06, 6, 664, 654.01, 661; 224/666, 224/669–671, 600, 601; 24/3.4, 3.12, 3.13
See application file for complete search history.

(56) References Cited

U.S. PATENT DOCUMENTS 268,102 A * 11/1882 Horton ..... 63/21
534,946 A * 2/1895 Bates ..... 224/220
1,567,021 A 12/1925 Detlefsen et al.
2,084,151 A * 6/1937 Leitner ..... 63/3.1
2,138,596 A * 11/1938 Fassnacht ..... 63/23
2,145,071 A 1/1939 Cave
D149,472 S * 5/1948 Chernow ..... D11/87
2,556,825 A * 6/1951 Smith ..... 40/6
2,572,889 A * 10/1951 Strykower ..... 224/258
2,613,466 A 10/1952 Bowder
2,650,444 A * 9/1953 Coyle ..... 40/651
2,779,523 A 1/1957 Klimkiewicz
3,170,311 A * 2/1965 Raphael ..... 63/3.1
3,427,823 A * 2/1969 Musillo ..... 63/3

(Continued)

FOREIGN PATENT DOCUMENTS

GB 21350 * 0/1914 ..... 63/1.1

OTHER PUBLICATIONS jewelrysupply.com from Jun. 20, 2001 retrieved from archive.org.*

(Continued)

*Primary Examiner*—Jack W. Lavinder
(74) *Attorney, Agent, or Firm*—Feldman Law Group, PC

(57) ABSTRACT

A fine jewelry chain made of precious metal, base metal, or metal alloy, which may be used by day as an ID card holder in the form of a necklace, bracelet, belt, or watch-type chain, and by night as a piece of decorative jewelry in the form of a necklace, bracelet, belt, or watch-type chain. The chain includes a looped metal clasp which may be used to hold an ID card, transparent ID card holder, pendant, or charm, or to secure the necklace to itself, thus creating a double-stranded "choker" style of necklace. The chain may also be worn in the lapel, draped through belt-loops, or otherwise strung around a portion of clothing or of the body. Decorative charms may also be purchased and the chain threaded through said charms to create a more unique or individual piece of jewelry. The ID cards and charms strung from the chain may also incorporate embedded chip technology, which would allow for the download and storage of personal security information.

11 Claims, 3 Drawing Sheets

U.S. PATENT DOCUMENTS 3,481,155 A * 12/1969 Cook ..... 63/3.2
4,215,497 A * 8/1980 Levy ..... 40/649
4,334,413 A 6/1982 Gaston et al.
D267,833 S * 2/1983 Anderson ..... D11/202
4,616,435 A * 10/1986 Perfect ..... 40/6
4,628,708 A * 12/1986 Ivey ..... 63/1.16
4,760,715 A 8/1988 Ramos, Jr.
4,891,956 A * 1/1990 MacDonald ..... 63/3
5,031,420 A * 7/1991 Song ..... 63/21
5,245,844 A * 9/1993 Panzer ..... 63/1.16
5,488,848 A * 2/1996 Huang ..... 70/456 R
5,586,374 A * 12/1996 Nishida ..... 24/599.8
D382,223 S * 8/1997 Harrison ..... D11/80
5,791,076 A 8/1998 Gailliard
5,802,876 A 9/1998 Miller et al.
5,979,184 A * 11/1999 Razza ..... 63/1.11
6,014,871 A * 1/2000 Romano ..... 63/41
6,070,434 A * 6/2000 Traver ..... 63/1.11
6,098,202 A 8/2000 Peck
6,140,936 A * 10/2000 Armstrong ..... 340/5.74
6,155,409 A 12/2000 Hettinger
6,170,127 B1 * 1/2001 Lim ..... 24/3.4
6,223,559 B1 * 5/2001 Coleman ..... 63/1.13
6,256,793 B1 * 7/2001 Arias et al. ..... 2/207
6,263,702 B1 * 7/2001 Lo ..... 63/1.11
6,293,128 B1 * 9/2001 Leufray-Simms ..... 63/23

OTHER PUBLICATIONS overthemoonjewelry.com from on or before Mar. 9, 2001, retrieved from archive.org.*
downtoearthjewelry.com from on or before Jun. 6, 2001, retrieved from archive.org.*

* cited by examiner

CONVERTIBLE IDENTIFICATION (ID) TAG AND JEWELRY

FIELD OF THE INVENTION

This invention relates generally to necklaces, lanyards, wearable chains and jewelry charms.

BACKGROUND OF THE INVENTION

In this day and age, security is of the utmost importance. Corporations and businesses have long used laminated ID cards as a quick and easy way of identifying a person, as well as a person's clearance for their premises. A quick look at an ID card suspended from a person's neck, pocket, or lapel assures that he/she has been cleared, and that he/she has permission to remain on the premises.

In the past, ID cards have frequently been strung from utilitarian lanyards made of cheap materials such as ball or beaded chain, and cotton or nylon material. A hook or badge clip is then slipped onto the loop of the lanyard and the entire contraption is then suspended from a person's neck. Lanyards and such are frequently used as a casual way of carrying not only ID tags, but also small, easily suspended items such as dorm room keys. Alternatively, a badge clip may also be independently used to suspend an ID card from a piece of clothing such as a pocket or a lapel, and this approach is favored in many corporations and agencies.

Fine jewelry in the form of a necklace or bracelet has previously been designed to fulfill functional, rather than decorative needs. U.S. Pat. No. 1,567,021 to Detlefsen et. al. shows a combined necklace and game apparatus, in which a decorative, lightweight box used for games and scoring is suspended from a beaded necklace. U.S. Pat. No. 4,891,956 to MacDonald shows an indicia device with a removable insert which may be suspended as a pendant or a charm. U.S. Pat. No. 2,613,466 to Bowder shows an identification assembly unit in which an insignia identifying the user/wearer is mounted on a chain, said insignia being made of metal, and capable of having the letters of the insignia rearranged in different combinations.

U.S. Pat. No. 6,155,409 to Hettinger shows a personal emergency information and medication holder in the form of a locket suspended as a pendant or a pocket watch, and equipped with a scannable code which may be used by emergency medical personnel in a time of crisis. U.S. Pat. No. 2,779,523 to Klimkiewicz shows a multipurpose costume accessory in which a chain has its end portions adapted to be transformed into loops, one of which is worn around the wrist in the form of a bracelet, the second of which hangs free in a kind of noose, and which may be attached to the carrying handle of, for example, a small handbag.

None of these previous patents, however, provides means for dual usage. The transformative aspect of the Convertible ID Tag and Necklace (utilitarian by day, stylish by night) make it uniquely capable of filling the gap which exists between fine jewelry and the hardware necessarily donned by employees in order to adequately display their ID cards.

SUMMARY OF THE INVENTION

The present invention provides a chain that may be made from a precious metal such as sterling silver, gold, or platinum, or from a base metal or metal alloy. A variety of chain styles may be used, such as with delicate or hardier links in a variety of shapes, sizes, and colors. The chain may be worn in one loop, doubled over to create a "choker" style necklace, or doubled over again to create a bracelet. The chain may also be worn as a decorative belt, or in the manner of a watch chain. The ID card/card holder substitutes for a watch in the case of the latter.

The chain includes a hanging clasp in the form of a decorative pendant, from which a transparent ID card holder may be hung, and into which the wearer may insert their own personal or corporate ID. The reverse side of the transparent holder provides space for a corporate logo or self-expression. An ID card may also be suspended from the clasp independently of the transparent ID card holder.

Other pendants and/or charms may be simultaneously suspended from the chain When the ID card/card holder is removed, the chain is transformed back into a piece of fine jewelry. Alternative pendants and charms may be suspended even from the pendant clasp itself.

Additionally, the ID card and or the charms may incorporate chip technology, which allows for the download and storage of personal security information. Having this technology embedded in one or more of the decorative charms would allow the charms to function simultaneously as identification and decoration.

The chain may be suspended from the neck, wrist, belt loops, lapel, or any location most convenient to and comfortable for the wearer.

DETAILED DESCRIPTION OF INVENTION

Figure 3:
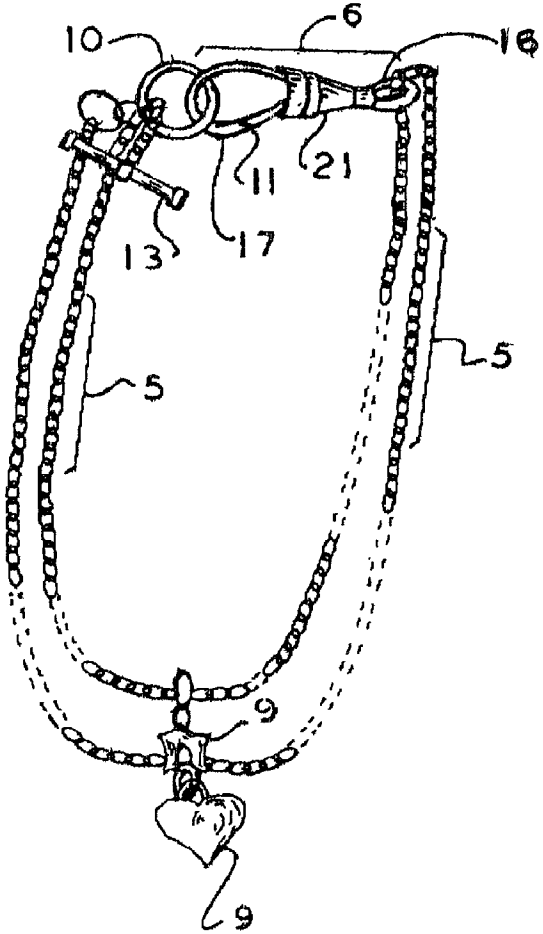
FIG. 3 illustrates a front view of the hanging chain doubled over and connected by clasp to opposite end of chain, thus creating a "choker" style necklace.
Figure 2:
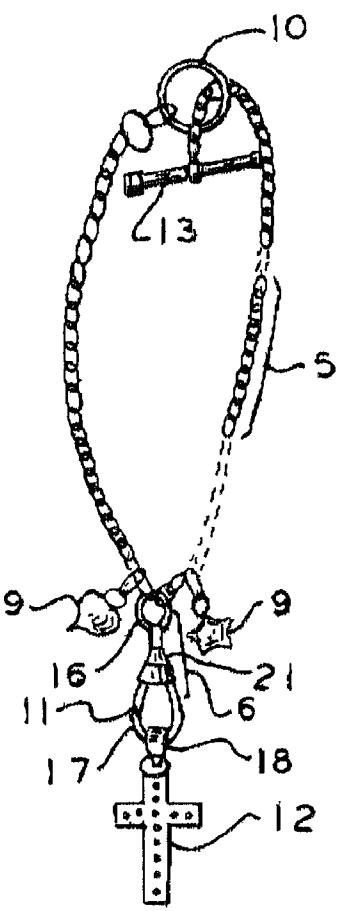
FIG. 2 illustrates a front view of the hanging chain with charms and sample cross pendant hung from clasp and replacing transparent ID card holder.

Referring now to each of the figures, in which multiple embodiments of the Convertible ID Tag and Necklace are shown. Each of FIGS. 1–3 shows a sample embodiment of the necklace and its uses.

Figure 1:
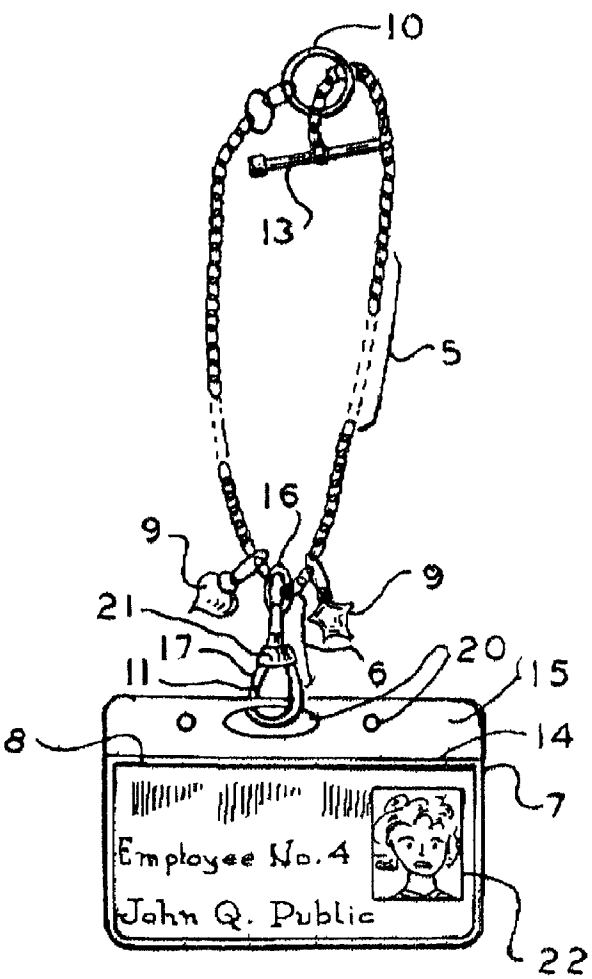
FIG. 1 illustrates a front view of the hanging chain with clasp and transparent ID card holder.

FIG. 1 shows the necklace being used to display an ID card. The necklace consists of a chain 5 made up of smallish metal links of a metal such as sterling silver, gold, platinum, etc. At one end of the chain is positioned a metal loop 10, which is large enough for a metal rod 13 to pass through, thus securing the chain. This type of fastener is decorative, and may be worn out of view (on the back of the neck, if the chain is being used as a necklace, or on the visible part of the chain). Other type of fasteners are contemplated and may be used, as long as they include a metal loop such as metal loop 10, which is large enough to be clasped by metal pendant clasp 6.

FIG. 1 also shows a metal pendant clasp 6 suspended from the chain 5. This metal pendant clasp 6 comprises a loop 16 through which the metal chain 5 may be threaded. Connected to this loop 16 is a decorative pendant base 21 from which the looped clasp 17 protrudes. This loop 17 has a separation 1, which allows the portion of the loop between the separation and the pendant base 21 to be depressed. When the wearer depresses this section of the loop 16, the separation widens to create an opening through which the opening 20 of transparent ID card holder 7 may be threaded so that the transparent ID card holder 7 is then suspended from metal pendant clasp 6. Other pendants such as pendant 12 in FIG. 2 may also be suspended from clasp 6 in the same manner.

The transparent ID card holder 7 may be a plastic, envelope-like receptacle of a rectangular shape into which a standard-sized ID card 8 may be inserted. Generally ID cards such as ID card 8 are made of a heavier plastic and include a photo of the bearer 22 for identification purposes. The top edge 14 of the ID card holder opens so that an ID card 8 may be slid in-between the layers of plastic. A tab 15 extends upward from the top front edge of the "envelope," and contains at least one hole 20. The loop 17 of pendant clasp 6 can be threaded through the hole 20 in order to suspend the ID card holder 7 from the pendant clasp 6. A corporate or personal ID card 8 may be slid into the ID card holder 7 for display. An ID card 8 may also be suspended in the dame manner from the pendant clasp 6 independent of ID card holder 7. Various other pendants in the form of charms, brooches, lockets, etc. 9 may also be suspended from chain 5, thereby being used in conjunction with pendant clasp 6 and ID card holder 7 in order to create a more decorative look and feel.

FIG. 2 shows the same necklace made from a chain 5 in a different embodiment. Here a pendant 12 is suspended by a metal loop 16 from the loop 17 of the pendant clasp 6. Two charms 9 flank the pendant 12, again, creating a decorative feel.

FIG. 3 shows the same necklace made from chain 5, except here the chain 5 has been doubled over to create a shorter, double-stranded "choker" type necklace. The chain 5 remains attached at both ends by the rod 13 being run through the metal loop 10. In this embodiment, the chain is then doubled over, and secured by sliding the loop 10 at one end of the chain through the opening 11 of the loop 17 of the pendant clasp 6. Again, a variety of charms 9 may be hung from the chain (s) of the now double stranded necklace FIG. 3.

Figure 4:
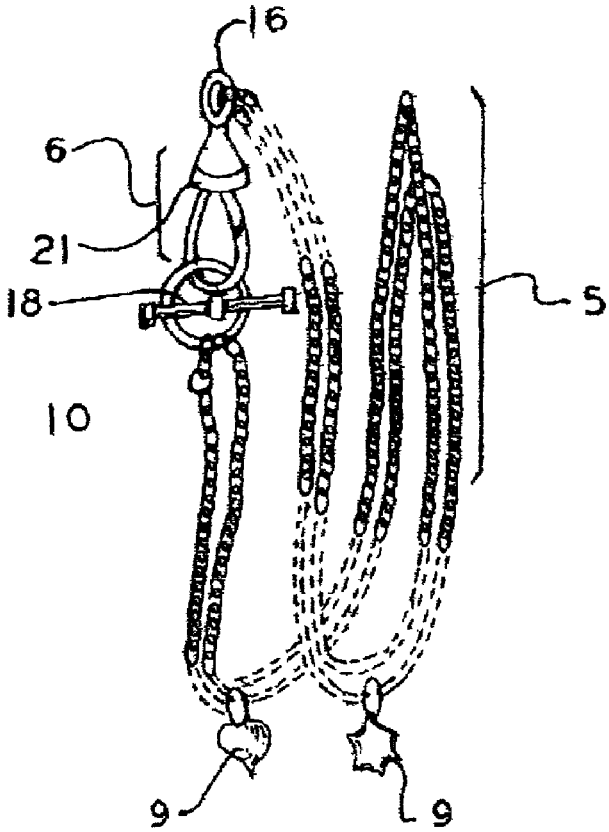
FIG. 4 illustrates a front view of the hanging chain doubled over twice, thus creating a bracelet.

FIG. 4 shows how, using the same connective process, the chain 5 may again be doubled over and twisted to form a series of bracelet sized loops which may be worn on the wrist 23. Additional pendants in the form of lockets, charms, or brooches etc. 9 may be suspended from chain 5 in this particular embodiment. Additional doubling over of the chain 5 will allow the chain 5 to fit an even smaller wrist 23, or create an even tighter fit.

Figure 5:
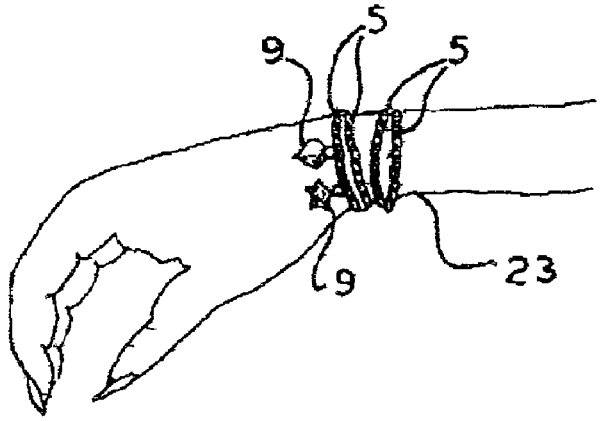
FIG. 5 illustrates a view of the hanging chain worn as a bracelet on the wrist.

FIG. 5 shows a view of chain 5 being worn on the wrist as described and shown by FIG. 4.

Figure 6:
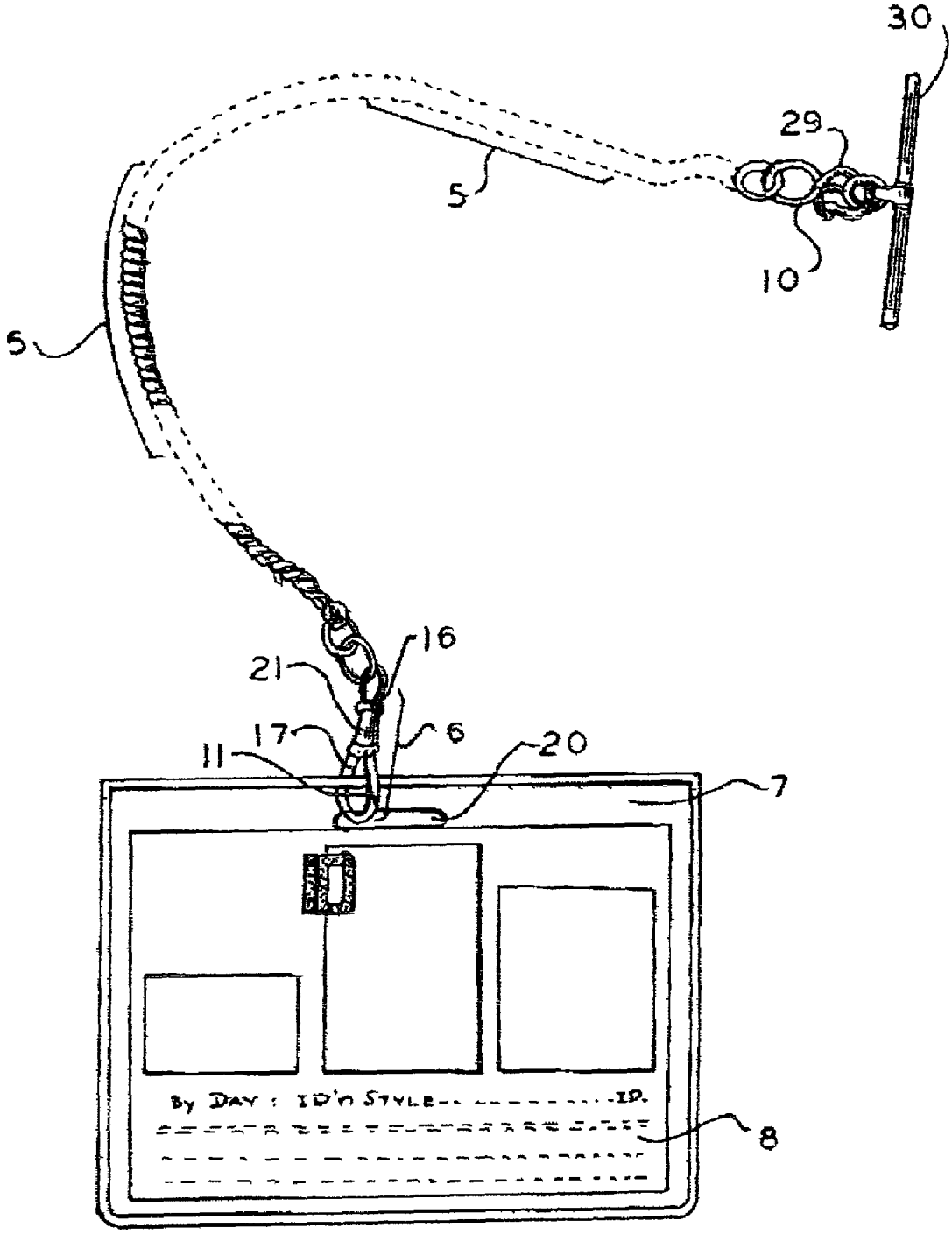
FIG. 6 illustrates a view of the shortened chain modified for hanging from the lapel.

FIG. 6 demonstrates modifications to chain 5 that allow it to be worn suspended from a lapel in the matter of a pocket-watch chain. In this embodiment, a metal rod 30 is attached by a set of chain links 29 to metal loop 10 to one end of shortened chain 5. Instead of connecting pendant 6 to metal loop 10 to form a connected loop, metal rod 30 is slipped through the lapel and so holds the shortened chain 5 in place. The transparent ID card holder 7 or an ID card 8 may then be suspended from decorative clasp 6. When the ID card 8 need no longer be displayed it may be tucked into the chest pocket of the wearer's shirt, leaving visible only decorative chain 5. Other charms, pendants, or lockets may also be suspended from decorative clasp 6 in the same manner.

Different varieties and styles of chain are also possible and contemplated that will fall within the spirit and scope of this invention as further defined by the claims that follow.

The invention claimed is:

1. A convertible identification tag and jewelry kit comprising:

a. a metal chain having a first and a second end;

b. first connecting means having a first part in the form of a metal loop attached to said first end of said chain, said first connecting means having a second part in the form of a metal rod attached to said second end of said chain for connecting said first and second ends of said chain by passing said metal rod through said metal loop, said metal rod being capable of being passed through said metal loop one or more times to form varying lengths of said metal chain;

c. second connecting means having a permanently attached top and bottom portion, said top portion being in the form of a loop, whereby said chain is feed through said loop, and said bottom portion being in the form of a multipurpose clasp which hangs away from said chain;

d. at least one ID card;

e. a transparent ID card holder; and f. a plurality of decorative brooches, lockets, pendants and charms, g. whereby at least one of said ID card and decorative brooches, lockets, pendants and charms is embedded with chip technology and are attached interchangeably with said multipurpose clasp, said chip technology allowing for the download and storage of personal security information.

2. The convertible identification tag and jewelry kit of claim 1 whereby said multipurpose clasp removably clips onto said ID card, transparent ID card holder and decorative brooches, lockets, pendants and charms as needed.

3. The convertible identification tag and jewelry kit of claim 1 whereby said transparent ID card holder has an opening into which said ID card is inserted, and said transparent ID card holder has a tab with at least one hole through which said clasp is looped.

4. The convertible identification tag and jewelry kit of claim 1 whereby said at least one ID card includes a corporate logo and is supplied separately from said kit.

5. The convertible identification tag and jewelry kit of claim 1 whereby said second connecting means or clasp suspends said ID card, transparent ID card holder and decorative brooches, lockets, pendants and charms.

6. The convertible identification tag and jewelry kit of claim 1 whereby said decorative brooches, lockets, pendants and charms incorporate loops for hanging.

7. The convertible identification tag and jewelry kit of claim 6 whereby said decorative brooches, lockets, pendants and charms are strung from said chain at intervals determined by the wearer.

8. The convertible identification tag and jewelry kit of claim 6 whereby said second connecting means or clasp is attached to said first part of said first connecting means in order to form a double stranded or choker-style necklace, and whereby said decorative brooches, lockets, pendants and charms are strung from said necklace at intervals determined by the wearer.

9. The convertible identification tag and jewelry kit of claim 6 whereby said double stranded or choker-style necklace is doubled over again to form a bracelet-style series of chain strands which are worn around the wrist as a bracelet, and whereby said decorative brooches, lockets, pendants and charms are strung from said chain at intervals determined by the wearer.

10. The convertible identification tag and jewelry kit of claim 6 whereby the chain is looped around the waist as a decorative belt, and whereby said decorative brooches, lockets, pendants and charms are strung from said chain at intervals determined by the wearer.

11. The convertible identification tag and jewelry kit of claim 1 whereby the chain is shortened and worn from a lapel in the manner of a pocket-watch chain, said chain having a metal rod at one end which is placed though the lapel to hold the chain in place.

* * * * *